US011411303B2

(12) United States Patent
Ahola et al.

(10) Patent No.: US 11,411,303 B2
(45) Date of Patent: Aug. 9, 2022

(54) ANTENNA ASSEMBLY FOR A WRIST WORN DEVICE

(71) Applicant: Suunto Oy, Vantaa (FI)

(72) Inventors: Tom Ahola, Vantaa (FI); Eero Varjonen, Vantaa (FI); Erik Lindman, Vantaa (FI)

(73) Assignee: Suunto Oy, Vantaa (FI)

( * ) Notice: Subject to any disclaimer, the term of this patent is extended or adjusted under 35 U.S.C. 154(b) by 446 days.

(21) Appl. No.: 16/684,610

(22) Filed: Nov. 15, 2019

(65) Prior Publication Data

US 2020/0176857 A1 Jun. 4, 2020

(30) Foreign Application Priority Data

Nov. 30, 2018 (FI) ..... 20186025
Nov. 30, 2018 (GB) ..... 1819543

(51) Int. Cl.

| | |
|---|---|
| ***H01Q 1/27*** | (2006.01) |
| ***H01Q 1/04*** | (2006.01) |
| ***B63C 11/26*** | (2006.01) |
| ***H01Q 21/30*** | (2006.01) |
| *B63C 11/02* | (2006.01) |

(52) U.S. Cl.
CPC ..... *H01Q 1/273* (2013.01); *B63C 11/26* (2013.01); *H01Q 1/04* (2013.01); *H01Q 21/30* (2013.01); *B63C 2011/021* (2013.01)

(58) Field of Classification Search
CPC ..... H01Q 21/30; H01Q 1/04; H01Q 1/273; B63C 11/26
See application file for complete search history.

(56) References Cited

U.S. PATENT DOCUMENTS

| | | | |
|---|---|---|---|
| 5,696,518 | A | 12/1997 | Itoh et al. |
| 2014/0266939 | A1 | 9/2014 | Baringer et al. |
| 2015/0295304 | A1 | 10/2015 | Bengtsson et al. |
| 2017/0050710 | A1 | 2/2017 | Gerges |
| 2017/0179573 | A1 | 6/2017 | Konanur et al. |
| 2018/0234190 | A1 | 8/2018 | Rauhala |
| 2018/0294553 | A1 | 10/2018 | Lim et al. |

FOREIGN PATENT DOCUMENTS

| | | | |
|---|---|---|---|
| CN | 104836016 | A | 8/2015 |
| CN | 204793174 | U | 11/2015 |
| GB | 2457581 | A | 8/2009 |
| GB | 2465872 | A | 6/2010 |
| GB | 2517422 | A | 2/2015 |
| JP | 2009094765 | A | 4/2009 |
| JP | 2010187065 | A | 8/2010 |
| WO | WO2011145515 | A1 | 7/2013 |

*Primary Examiner* — Graham P Smith
(74) *Attorney, Agent, or Firm* — Laine IP Oy

(57) ABSTRACT

The invention concerns an antenna assembly for a wearable or wrist worn device, the device being suitable for underwater communications, comprising a casing, comprising an inductive coil antenna, wherein the inductive coil antenna is attachable to a housing and said housing, comprising a first radio operating on a first frequency band for communication underwater and a second radio operating on a second frequency band for communication over air interface, wherein the second frequency band is higher than the first frequency band, and the first and the second radio operate using the inductive coil antenna when said casing is attached to said housing.

20 Claims, 5 Drawing Sheets

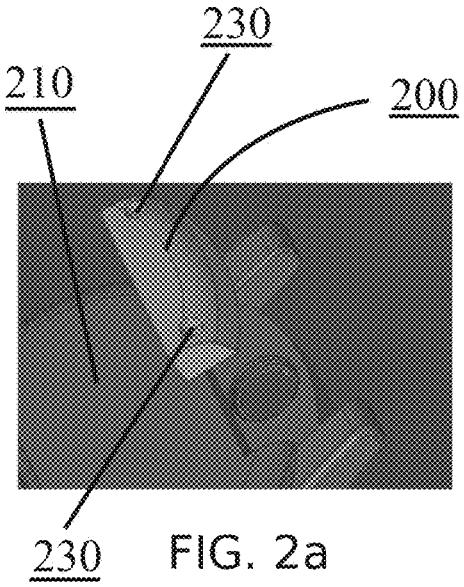
FIG. 2a
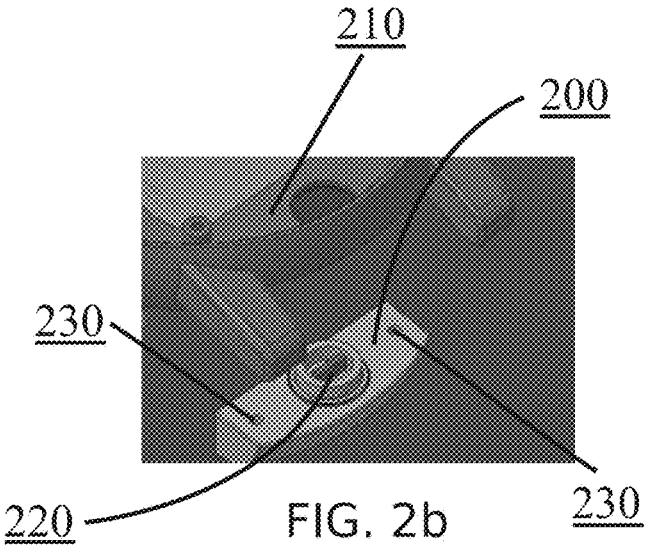
FIG. 2b
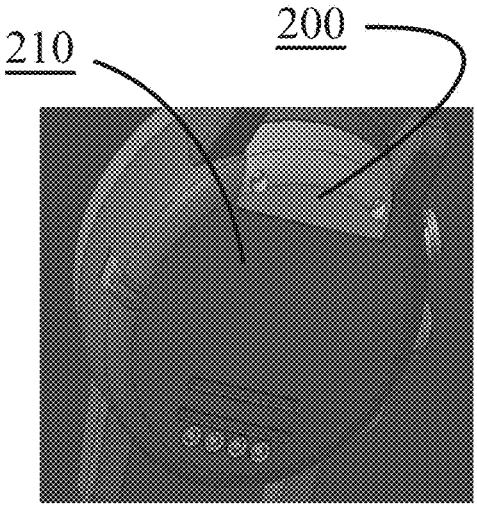
FIG. 2c
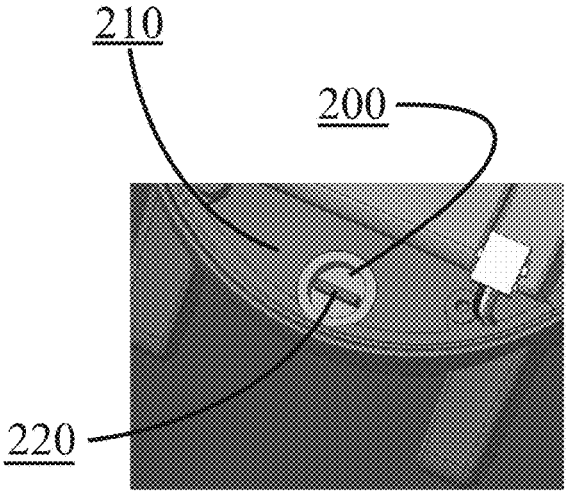
FIG. 2d
FIG. 2

ANTENNA ASSEMBLY FOR A WRIST WORN DEVICE

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNOLOGICAL FIELD

The present disclosure relates generally to wrist worn devices. More specifically, the present disclosure relates to an antenna assembly for wrist worn devices.

BACKGROUND OF THE INVENTION

Antenna assemblies are commonly found in modern radio devices, such as mobile computers, portable navigation devices, mobile phones, smartphones, personal digital assistants (PDAs), wrist worn device or other personal communication devices (PCD). Typically, different devices, applications and use cases may require different antenna assemblies. For example, an antenna assembly for a device that is used for communication underwater may require a different antenna assembly than a device that is used for communication over air interface.

More recently, it has become desirable to design wrist worn devices which are capable of both, underwater communications and communication over air interface. As an example, in the context of scuba diving it may be desirable to have a wrist worn device which may communicate underwater with a gas tank or cylinder, which is attached to the diver. Communication over air interface may be used for other purposes though, such as, communicating with a mobile phone, a heart rate belt or a computer.

Accordingly, there is a salient need for an antenna assembly for use with a wearable or wrist worn radio device, which enables underwater communications and communication over air interface.

SUMMARY OF THE INVENTION

An antenna assembly for a wearable or wrist worn device, which is suitable for underwater communications and communication over air interface, may use at least two radios via at least one antenna. For example, the at least one antenna may be located in a casing which may be attachable to a housing of the wearable or wrist worn device. Moreover, the housing may comprise said two radios. This offers significant advantages. For example, proper functioning of the at least one antenna is ensured even if the wearable or wrist worn device would be made of metal, because the at least one antenna is located in the casing, outside of the housing. Also, the wearable or wrist worn device may comprise at least two radios while being small.

According to a first aspect, there is provided an antenna assembly for a wearable or wrist worn device, the device being suitable for underwater communications, comprising a casing, comprising an inductive coil antenna, wherein the inductive coil antenna is attachable to a housing and said housing, comprising a first radio operating on a first frequency band for communication underwater and a second radio operating on a second frequency band for communication over air interface, wherein the second frequency band is higher than the first frequency band, and the first and the second radio operate using the inductive coil antenna when said casing is attached to said housing.

According to the first aspect, said first radio may operate on the first frequency band and said second radio may operate on the second frequency band simultaneously using the inductive coil antenna.

According to the first aspect, said housing may further comprise an opening for attaching said casing to said housing.

According to the first aspect, said housing may further comprise a multiplexer between said first radio and said opening, and said multiplexer may be arranged to block signals on frequencies higher than a threshold.

According to the first aspect, said multiplexer may be arranged to block signals on the second frequency band.

According to the first aspect, said housing may further comprise a matching circuit between said second radio and said opening.

According to the first aspect, said housing may further comprise a first capacitor connectable to said inductive coil antenna, said first capacitor being a tuning capacitor for said inductive coil antenna.

According to the first aspect, said housing may further comprise two connection points for connecting said first capacitor and said inductive coil antenna via wires.

According to the first aspect, said casing may further comprise a construction connected to one end of said inductive coil antenna or both ends of said inductive coil antenna for receiving signals on the second frequency band, wherein said construction is preferably a patch, a wire or a stripline.

According to the first aspect, said antenna casing may be made of plastic and/or said housing may be made of metal.

According to the first aspect, said housing may encompass a wristwatch-like device.

According to the first aspect, said first radio may be a low-frequency band inductive receiver operating below 1 MHz.

According to the first aspect, said second radio may be a Bluetooth radio operating on frequencies from 2.4 to 2.485 GHz.

According to the first aspect, said housing may have the shape of a ring, an ellipse, a rectangle, a square, or any other polygon.

According to the first aspect, said casing may further comprise an antenna extension for improving antenna efficiency at high frequencies.

According to a second aspect, there is provided an electronic wristwatch-like device comprising an antenna assembly according to the first aspect.

The inventive antenna assembly and wristwatch-like device are characterized by what is set forth in the appended claims. Further features of the present disclosure, its nature and various advantages will be more apparent from the accompanying drawings and the following detailed description.

BRIEF DESCRIPTION OF THE DRAWINGS

The features, objectives and advantages of the present disclosure will become more apparent from the detailed description set forth below, when taken in conjunction with the drawings, wherein:

FIG. 2 illustrates an exemplary wrist worn device from different angles of view in accordance with some embodiments of the present invention;

FIG. 2*a* illustrates an exemplary wrist worn device from a first angle of view in accordance with some embodiments of the present invention;

FIG. 2*b* illustrates an exemplary wrist worn device from a second angle of view in accordance with some embodiments of the present invention;

FIG. 2*c* illustrates an exemplary wrist worn device from a third angle of view in accordance with some embodiments of the present invention;

FIG. 2*d* illustrates an exemplary wrist worn device from a fourth angle of view in accordance with some embodiments of the present invention.

DETAILED DESCRIPTION OF EMBODIMENTS

Figure 1:
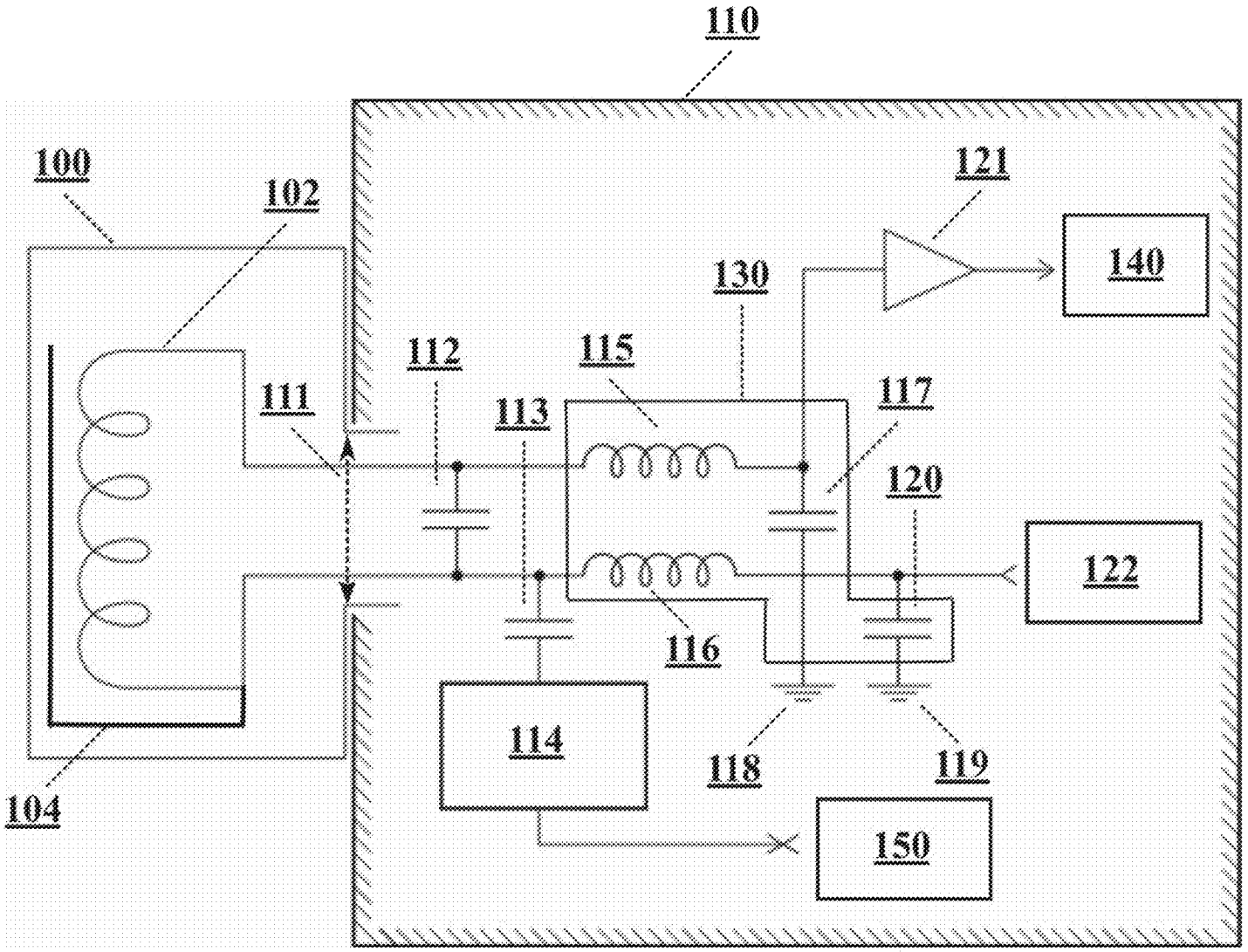
FIG. 1 illustrates an exemplary antenna assembly for a wearable or wrist worn device in accordance with some embodiments of the present invention.

Embodiments of the present invention provide an antenna assembly for a wearable or wrist worn device and a wrist-watch-like device suitable for underwater communications. For example, an antenna assembly for a wrist worn device may use two radios via one antenna. Said antenna may be in a casing which is attachable to a housing comprised in the device. This offers significant advantages as, for example, in case of small products multiple antennas in a housing would consume a lot of space. Moreover, said housing may be made of metal because the antenna is within said casing, which may be made of plastic. In addition, such a solution is particularly advantageous for wearable or wrist worn devices which are suitable for underwater communications.

Use of multiple antennas would require multiple antenna connections protruding from said housing, but according to the present invention the number of antenna connections is minimized by using only one antenna construction for multiple bands, thereby reducing the risk of water leakage to the housing. That is to say, according to some embodiments of the present invention, there may be multiple antennas in one antenna assembly, and said antenna assembly may comprise one water-proof feedthrough, such as a grommet or insulating bushing, on the housing. In general, embodiments of the present invention minimize the number of electrical connections and mechanical feedthroughs in the housing.

Embodiments of the present invention enable addressing the above challenges by using an inductive coil antenna for two radios, for example for a low-frequency inductive near-field communication radio and a Bluetooth radio. Also, said two radios may be used simultaneously, if needed.

Even though antenna multiplexing may be known in general, typically it is used to combine several antennas into one cable. For example, radio amateurs may reduce the number of cables required in a mast, which comprises several antennas for various radio bands, by combining several antennas into one cable. It may also be known that, for example, in portable radios a headphone cable may be used as a radio antenna. Nevertheless, such a solution does not correspond to using one antenna for two radios either.

The present invention is aimed at an antenna assembly for a wearable or wrist worn device, wherein the device requires means for underwater communications and means for communicating over air interface. The wearable or wrist worn device may be, for example, a device for scuba diving. Such a device may be used, e.g., by divers and communication underwater may be needed for information exchange between the wrist worn device and a gas tank or cylinder attached to a diver. The gas tank or cylinder may comprise breathing gas, e.g., compressed air, for the scuba diver. Therefore it is desirable to transfer at least some information related to the pressure of the gas tank or cylinder to the diver, so that the diver can see directly from the screen of the wearable or wrist worn device how much air is left and an estimate on how long it will last.

Communication using radio signals is challenging underwater, as electro-magnetic waves propagate only over extremely short distances in water. Naturally, lower frequencies provide longer distances. Low frequencies, such as, 5.3 kHz or 123 kHz, are hence generally used for data transmission underwater. In diving applications, signals on such frequencies may travel in water for the required distance from the gas tank or cylinder to the wearable or wrist worn device. Communication underwater may be performed using an inductive receiver/transmitter, or any other receiver/transmitter which is suitable for low-frequency transmissions.

Divers may also have a need for communicating with various devices over air interface, i.e., above the surface of water. As an example, a wearable or wrist worn device may communicate with a mobile phone, a heart rate belt, or a computer and transfer some information related to the diver or diving in general. Typically, communication with a mobile phone, a heart rate belt, or a computer may require higher data rates than communications underwater. Higher data rates may be achieved by exploiting higher frequencies due to the available bandwidth. Air as a transmission medium does not attenuate radio signals as much as water and hence the use of higher frequencies is feasible above the surface.

For many applications it would be desirable to use a standardized communication technology for communicating over air interface. As an example, Bluetooth or some other wireless technology may be used, such as, Wireless Local Area Network, WLAN. Cellular communication technology may be used as well, e.g., Wideband Code Division Multiple Access, WCDMA, Long Term Evolution, LTE, or 5G, which may be referred to as New Radio, NR, as well.

Many, if not all, of these communication technologies use frequencies above 1 MHz. A Bluetooth radio for example may operate on frequencies from 2.4 to 2.485 GHz. However, a low-frequency inductive receiver/transmitter is not suitable for communications on such frequencies. So without any adjustments to an antenna assembly a second radio, e.g., a Bluetooth radio, would require its own antenna.

According to some embodiments of the present invention, a circuit may be provided for combining a Bluetooth antenna and an antenna of a low-frequency inductive transmitter/receiver. Embodiments of the present invention are not restricted to Bluetooth though and another communication technology which operates on higher frequencies, such as above 1 MHz, may be used as well.

FIG. 1 illustrates an exemplary antenna assembly for a wrist worn device in accordance with some embodiments of the present invention. The exemplary antenna assembly of FIG. 1 may comprise casing 100. In some embodiments of the present invention casing 100 may be made of plastic. Also, casing 100 may be referred to as a plastic antenna casing. The present invention is not limited to plastic casing 100 though. In general any material that does not block electromagnetic signals, or attenuate too much, may be used.

Casing 100 may be a small part outside of housing 110 and width of casing 100 may be, for example, around the size of a fingertip. Hence FIG. 1 may not represent physical sizes of casing 100 and housing 110 in correct proportion and the size of casing 100 may be much smaller than the size of housing 110, if housing 110 forms, e.g., a wristwatch-like device. That is to say, for illustrative purposes the size of casing 100 may be larger in FIG. 1 compared to practical implementation.

In some embodiments of the present invention, casing 100 may provide a combined inductive receiver coil and a Bluetooth antenna. Casing 100 may comprise first inductor 102 which may be an inductive receiver coil. Moreover, radiation at high frequencies, such as above 1 MHz, may be improved by adding additional constructions to the antenna design. For example, casing 100 may comprise at least one of said constructions, shown as exemplary element 104 in FIG. 1. Said constructions may be, e.g., a patch, wire or stripline connected to one end of inductor 102. Alternatively, patches, wires or striplines, for example, may be connected to both ends of inductor 102.

Alternatively, or in addition, performance of second radio 150 may be improved by elongating a section of wires on the outside of housing 110, within casing 100, going from opening 111 to inductor 102. Such wires may generate magnetic field while first inductor coil 102 may act as a capacitance for free-space, generating electric field. Furthermore, in some embodiments of the present invention said wires may be arranged in a zigzag way.

Casing 100 may be attachable to housing 110. Housing 100 may form a wrist worn device itself or together with casing 100, e.g., for underwater sports, such as scuba diving. The wrist worn device may be for example a watch. With reference to FIG. 2, Casing 100 may be attachable to housing 110 using various attaching means, such as, a screw, locking ring, dove tail, key or other locking feature (see FIG. 2*d*).

Moreover, casing 100 may be connectable to housing 110 via two wires. Housing 110 may comprise connection points (not shown in FIG. 1) for the wires close to opening 111. More specifically, casing 100, and first inductor 102 of casing 100, may be connectable to first capacitor 112 of housing 110 via the connection points. First capacitor 112 may also be connected to the connection points via two wires. In some embodiments, first capacitor 112 may be in casing 100 and associated with, or in connection with, first inductor 102.

Therefore, when casing 100 is attached to housing 110, first capacitor 112 may be associated with first inductor 102 via the wires and connection points. First capacitor 112 may form together with first inductor 102 a tuned circuit, or resonator. Said tuned circuit may have a tuned frequency determined by component values of first capacitor 112 and first inductor 102. Sensitivity of the inductive receiver may be highest at the tuned frequency. Thus, the tuned frequency may be designed to be as close as possible to the operation frequency of the inductive communication. Thus, for example a signal received by first inductor 102 may be transferred to first capacitor 112 via the wires and the connection points.

First capacitor 112 of housing 110 may be connected to second capacitor 113 of housing 110. Moreover, second capacitor 113 may be connected to matching circuit 114 inside housing 110. According to some embodiments of the present invention, inductive coil antenna 102 may be neither a resonant nor an effective radiator at higher frequencies, such as, from 2.4 to 2.485 GHz, which may be exploited for communicating using Bluetooth technology. However, with a properly designed matching circuit 114 the antenna assembly may provide a compromise at reduced communication ranges.

Matching circuit 114 may be used to match an impedance of an antenna to an impedance of a radio, so that a radio signal may travel as efficiently as possible. That is to say, a Standing Wave Ratio, SWR, may be minimized, i.e., return loss maximized. An implementation may be done using T- or pi-match circuit, typically comprising capacitors and coils. On high frequencies it may be desirable to exploit various stripline constructions for implementing matching circuit 114 as well.

Furthermore, housing 110 may comprise multiplexing circuit 130. As an example, multiplexing circuit 130 may be formed by second inductor 115, third inductor 116, third capacitor 117 and fourth capacitor 118. First capacitor 112 may be connected to multiplexing circuit 130. For example, first capacitor 112 may be connected to second inductor 115 of multiplexing circuit 130. In addition, first capacitor 112 may be connected to third inductor 116 of multiplexing circuit 130 and to second capacitor 113.

Second inductor 115 of multiplexing circuit 130 may be connected to third capacitor 117 and to a Low-Power Amplifier, LNA, 121 within housing 110. Also, third capacitor 117 may be connected to first ground point 118 as well. In addition, LNA 121 may be further connected to first radio 140.

In some embodiments of the present invention, first radio 140 may be suitable for operating on a first frequency. For example, first radio 140 may be an inductive receiver/transmitter and it may be suitable for communication underwater. In some embodiments, first radio 140 may be also suitable for communication above water, i.e., over air interface. That is to say, first radio 140 may be used for both, underwater communication and communication over air interface. For example, first radio 140 may be operating on frequency of 5.3 kHz or on frequency of 123 kHz. In any case, first radio 140 is usually operating on a frequency which is below a certain threshold, such as, for example, 1 MHz. As an example, in the context of scuba diving, first radio 140 may be used to communicate with a gas tank or cylinder for transferring information related to the pressure of the gas tank or cylinder.

Third inductor 116 of multiplexing circuit 130 may be connected to fourth capacitor 120. Furthermore, fourth capacitor 120 may be connected to second ground point 119 as well. In addition, or alternatively, fourth capacitor 118 and third inductor 116 may be connected to LNA bias voltage generator 122.

Therefore, LNA biasing voltage generator 122 may be connected to one end of coil antenna and the other end is connected to LNA 121 that amplifies the signal to the receiver. Alternatively, a balanced LNA may be used. A transmitter circuit may also be included (not shown in FIG. 1).

In addition, housing 110 may comprise matching circuit 114, which may be connected to second radio 150. Matching circuit 114 may be in between second radio 150 and opening 111. Hence, matching circuit 114 may be in between second radio 150 and inductive coil antenna 102 when casing 100 is attached to housing 110. Second radio 150 may be operating on a second frequency, wherein the second frequency is higher than the first frequency.

In some embodiments of the present invention, second radio 150 may be operating according to a wireless technology standard, e.g., Bluetooth technology. For example, second radio 150 may be a Bluetooth receiver/transmitter for communication with a mobile phone, heart rate belt or a computer. In general, second radio 150 may be suitable for communication over air interface. Second radio may be operating on frequencies from 2.4 to 2.485 GHz, but in any case second radio 150 is usually operating on a frequency which is above the threshold, e.g., 1 MHz.

According to some embodiments of the present invention, multiplexing circuit 130 may not have any effect on the operation of the inductive communication (using first radio 140) at low frequencies, e.g., below 1 MHz. But on the other hand, at high frequencies, e.g., above 1 MHz, multiplexing circuit 130 may isolate inductive antenna 102 from inductive receiver circuit 140. Hence, inductive antenna 102 may be used by second radio 150 instead, via second capacitor 113 and matching circuit 114. In that case low-frequency signals related to first radio 140 would not interfere with higher frequency signals related to second radio 150. Thus, for example Bluetooth communications would not be interfered by the low-frequency signals and Bluetooth signals related to second radio would not pass multiplexing circuit 130 to inductive receiver 150. This way both, first radio 140 and second radio 150, may be used simultaneously.

FIG. 2 illustrates an exemplary wrist worn device from different angles of view in accordance with some embodiments of the present invention. With reference to FIG. 1, in FIGS. 2*a*-2*d*, casing 200 may correspond to casing 100 of FIG. 1 while housing 210 may correspond to housing 110 in FIG. 1. In addition, the exemplary device of FIG. 2 may comprise connecting means 220 for connecting casing 200 to housing 210. In general, connecting means 220 may comprise a circuit board and said circuit board may comprise a slot for electrically connecting casing 200 to housing 210. For example, said circuit board may be a Printed Circuit Board, PCB.

The exemplary device of FIG. 2 may also comprise two slots, or holes, 230 for attaching means, however, in general there may be one or more slots, or holes, 230 for attaching means. Said attaching means may comprise, for example, a screw (not shown in FIG. 2).

First, in FIG. 2*a*, an exemplary wrist worn device from a first angle of view in accordance with some embodiments of the present invention is illustrated. As shown in FIG. 2, casing 200 may be detached from housing 210.

Secondly, FIG. 2*b* illustrates an exemplary wrist worn device from a second angle of view in accordance with some embodiments of the present invention. FIG. 2*b* also shows an arrangement, wherein casing 200 is detached from housing 210. In addition, exemplary connecting means 220 are shown in FIG. 2*b*. Also, two slots, or holes, 230 for attaching means are shown as well.

FIG. 2*c* illustrates an exemplary wrist worn device from a third angle of view in accordance with some embodiments of the present invention. FIG. 2*c* shows an arrangement, wherein casing 200 is attached to housing 210. Generally speaking, casing 200 may be attachable to housing 210 using attaching means.

FIG. 2*d* illustrates an exemplary wrist worn device from a fourth angle of view in accordance with some embodiments of the present invention. FIG. 2*d* also shows an arrangement, wherein casing 200 is attached to housing 210. In addition, FIG. 2*d* shows exemplary connecting means 220.

Figure 3:
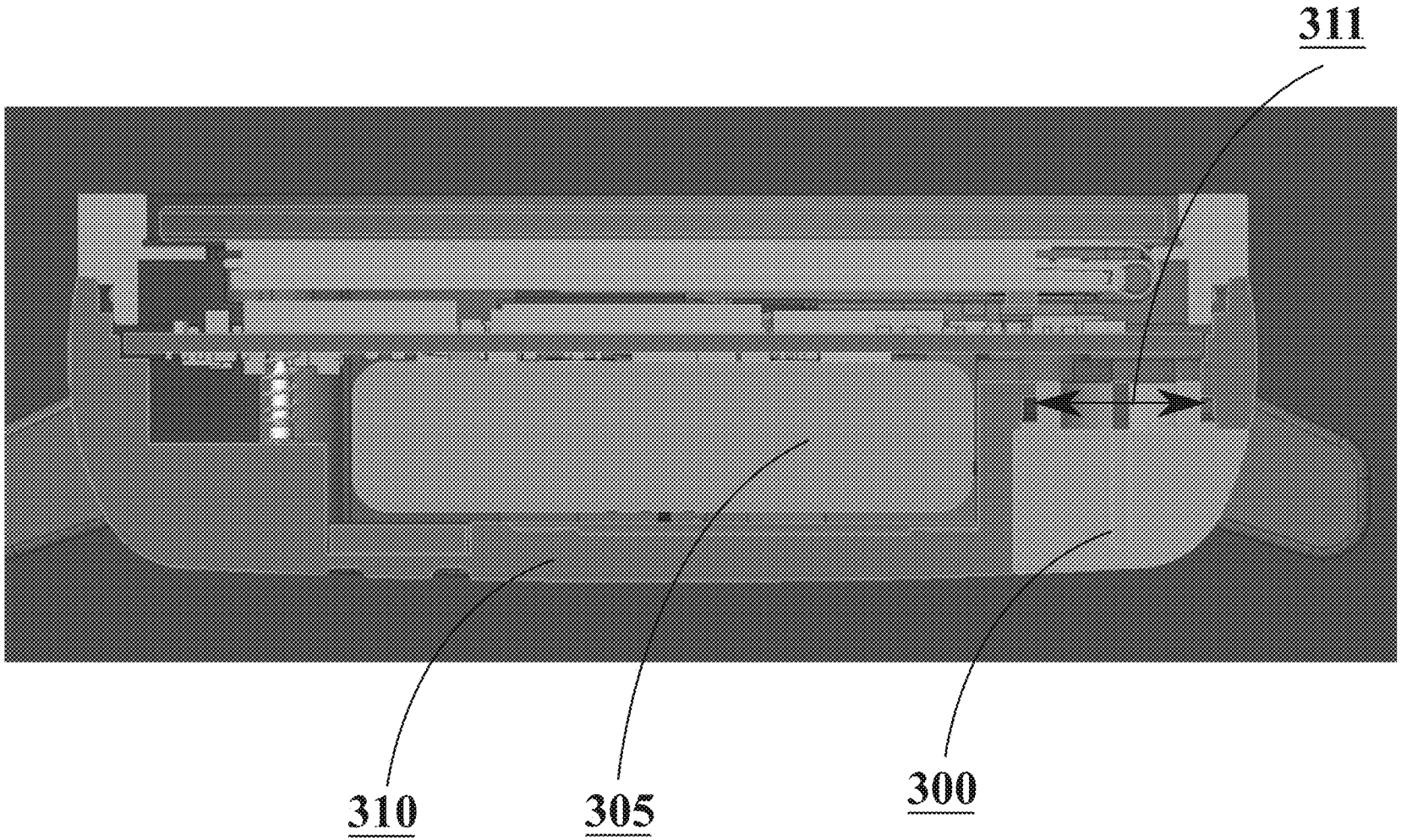
FIG. 3 illustrates a cross-section of an exemplary wrist worn device in accordance with some embodiments of the present invention.

FIG. 3 illustrates a cross-section of an exemplary wrist worn device in accordance with some embodiments of the present invention. With reference to FIG. 1 and FIG. 2, casing 300 of FIG. 3 may correspond to casing 100 in FIG. 1 and casing 200 in FIG. 2. Also, housing 310 in FIG. 3 may correspond to housing 110 in FIG. 1 and housing 210 in FIG. 2. Similarly, FIG. 3 demonstrates an opening 311 for connecting an inductive antenna of casing 300 to housing 310, which may correspond to opening 111 in FIG. 1. The exemplary wrist worn device of FIG. 3 may also comprise battery 305.

Figure 4A:
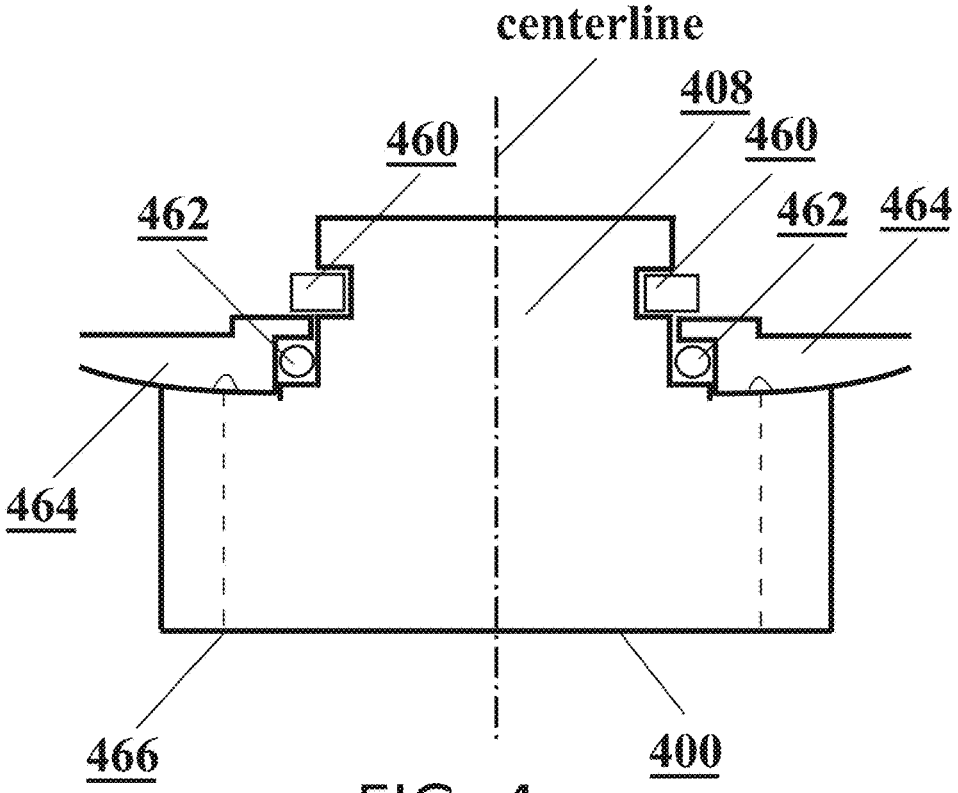
FIG. 4*a* illustrates an exemplary arrangement in accordance with some embodiments of the present invention.
Figure 4B:
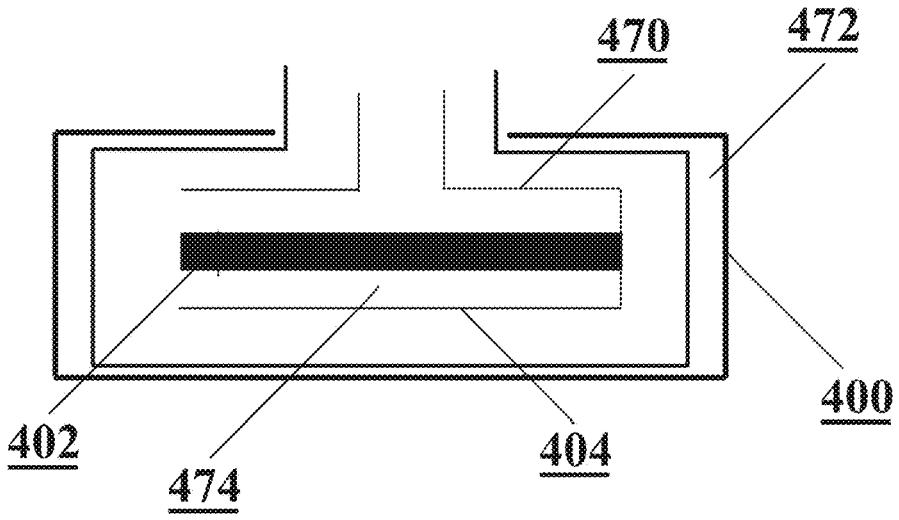
FIG. 4*b* illustrates an exemplary first casing in accordance with some embodiments of the present invention.

With reference to FIG. 1, casing 400 in FIGS. 4*a* and 4*b* may correspond to casing 100 of FIG. 1. FIG. 4*a* illustrates an exemplary arrangement in accordance with some embodiments of the present invention. In FIG. 4*a*, lock ring 460 and O-ring 462 are shown. Also, FIG. 4*a* demonstrates walls 464 of the housing. Locating pins or hole screws 466 may be used to attach casing 400 to walls 464 of the housing. Casing 400 may comprise, or be attached to, shaft 408. Shaft 408 may be suitable for insertion to an opening of the housing, i.e., suitable for insertion between walls 464 of the housing. Moreover, shaft 408 of FIG. 4 may correspond to shaft 508 of FIG. 5.

FIG. 4*b* illustrates an exemplary first casing in accordance with some embodiments of the present invention. Again, with reference to FIG. 1, inductor 402 may correspond to first inductor 102 in FIG. 1, i.e., a coil, while additional construction 404 may correspond to construction 104. Additional construction 104, 404 may be referred to as an antenna extension, for example, an L-antenna, which may be used to improve antenna efficiency at high frequencies.

Casing 400 may comprise leads 470 as shown in FIG. 4*b*. Casing 400 may also comprise possibly encapsulation material, for example epoxy, 472 and, a polymer for construction, such as, for example, Grilamid LV 3H. In some embodiments, the polymer for construction may be suitable for use together with encapsulation epoxy 472 in order for the encapsulated antenna arrangement to be insert molded with the polymer to create the casing. Insert molding without the encapsulation material is also possible. Casing 400 may also comprise circuit board 474. Circuit board 474 may be a PCB.

Figure 5:
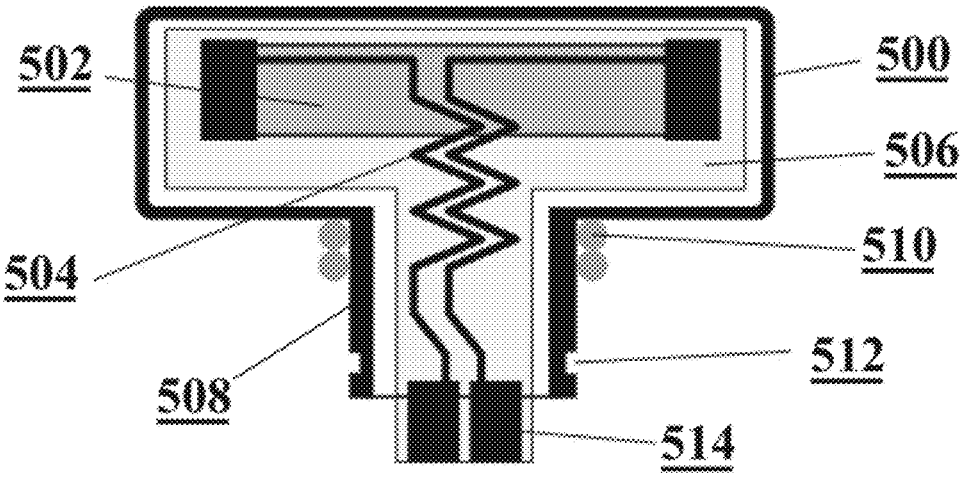
FIG. 5 illustrates an exemplary second casing in accordance with some embodiments of the present invention.

FIG. 5 illustrates an exemplary second casing in accordance with some embodiments of the present invention. With reference to FIG. 1, casing 500 in FIG. 5 may correspond to casing 100 of FIG. 1 while inductor 502 may correspond to first inductor 102 in FIG. 1. Thus, inductor 502 may be a low frequency antenna coil. In addition, the casing of FIG. 5 may comprise Radio Frequency, RF, inductor 504. Moreover, RF inductor 504 may be referred to as an antenna extension. Hence, RF inductor 504 may be used to improve antenna efficiency at high frequencies. Moreover, RF inductor 504 may be made from circuit board traces. Said circuit board traces may further improve antenna efficiency at high frequencies. In general, high frequency may refer to the second frequency band or any frequency above 1 MHz.

Casing 500 of FIG. 5 may also comprise circuit board 506. Circuit board 506 may be a PCB. In addition, casing 500 of FIG. 5 may comprise one or more O-ring gaskets 510. Said one or more O-ring gaskets may go around shaft 508. In some embodiments, shaft 508 may be round, i.e., cylindrical. Casing 500 may further comprise one locking groove 512. Locking groove 512 may also go around shaft 508. A locking ring may be attached to locking groove 512 for placing casing 500, i.e., for keeping casing 500 in place. Casing 500 may also comprise at least one, possibly two, connection terminals 514.

Thus, embodiments of the present invention provide an antenna assembly for a wearable or wrist worn device and an electronic wristwatch-like device suitable for communications underwater and over air interface. Housing of the antenna assembly may be made of metal, because an inductive antenna may be taken out of the housing via an opening. Embodiments of the present invention are not restricted to a housing made of metal though, but in general any material may be used, regardless of whether the material blocks electromagnetic signals, or attenuates electromagnetic signals too much.

As there is only one inductive antenna, the number of openings is minimized, thereby enabling a water-proof device. The antenna assembly may also include a low-frequency inductive receiver/transmitter and a Bluetooth radio, which may use the same inductive antenna for communication via only one opening and one antenna component.

The wearable or wrist worn device and the electronic wristwatch-like device may be for scuba diving and the devices may form a part of the system and arrangement described, e.g., in U.S. patent application Ser. No. 12/327,615. The system and arrangement may comprise a gas tank or cylinder and a pressure sensor attached to the gas tank or cylinder. The gas tank or cylinder may also comprise a transmitter for transmitting information underwater related to the pressure of the gas tank or cylinder while the device may comprise a receiver for receiving the information. In general, magnetic induction is good for underwater communications, even though it has a short range. In some embodiments of the present invention, frequency of 123 kHz may be used for such communications. The wearable or wrist worn device and the electronic wristwatch-like device may also comprise a Bluetooth radio as a second radio. The Bluetooth radio may be used for communication over air interface.

The wearable or wrist worn device and the electronic wristwatch-like device may also comprise a housing, which may be made of metal. However, it may be impossible to take either of the radios out of the device. Embodiments of the present invention therefore provide a casing, which comprises an inductive antenna, an said inductive antenna may be taken out from the device. The casing may be made of plastic.

Embodiments of the present invention provide a structure which works all the time for both radios, wherein multiple radios may be coupled to one antenna. Induction may be used for communication with the gas tank or cylinder while Bluetooth may be used for communication with a mobile phone, heart rate belt or a computer over air interface. Bluetooth technology may provide reasonable data rates while induction may provide only small data rates, but induction enables wireless communication underwater.

According to some embodiments of the present invention the wrist worn device may be a smart clock which is used as a diving computer. The device may have a wireless connection to a gas tank or cylinder, to enable transmission of the pressure of the gas tank or cylinder. Even though some watches for diving may be known, those may not enable transmitting the pressure of the gas tank or cylinder to the device.

It will be recognized that while certain aspects of the present disclosure are described in terms of a specific sequence of steps of a method, these descriptions are only illustrative of the broader methods of the disclosure, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the disclosure disclosed and claimed herein.

While the above detailed description has shown, described, and pointed out novel features of the antenna assembly as applied to various embodiments, it will be understood that various omissions, substitutions, and changes in the form and details of the device or process illustrated may be made by those skilled in the art without departing from the fundamental principles of the antenna apparatus. The foregoing description is of the best mode presently contemplated of carrying out the present disclosure. This description is in no way meant to be limiting, but rather should be taken as illustrative of the general principles of the present disclosure. The scope of the present disclosure should be determined with reference to the claims.

The invention claimed is:

1. An antenna assembly for a wearable or wrist worn device, the device being suitable for underwater communications, comprising:

a casing, comprising an inductive coil antenna, wherein the inductive coil antenna is attachable to a housing; and said housing, comprising a first radio operating on a first frequency band for communication underwater and a second radio operating on a second frequency band for communication over air interface, wherein the second frequency band is higher than the first frequency band, and the first and the second radio operate using the inductive coil antenna when said casing is attached to said housing.

2. The antenna assembly according to claim 1, wherein said first radio operates on the first frequency band and said second radio operates on the second frequency band simultaneously using the inductive coil antenna.

3. The antenna assembly according to claim 1, wherein said housing further comprises an opening for attaching said casing to said housing.

4. The antenna assembly according to claim 3, wherein said housing further comprises a multiplexer between said first radio and said opening, and said multiplexer is arranged to block signals on frequencies higher than a threshold.

5. The antenna assembly according to claim 4, wherein said multiplexer is arranged to block signals on the second frequency band.

6. The antenna assembly according to claim 3, wherein said housing further comprises a matching circuit between said second radio and said opening.

7. The antenna assembly according to claim 1, wherein said housing further comprises a first capacitor connectable to said inductive coil antenna, said first capacitor being a tuning capacitor for said inductive coil antenna.

8. The antenna assembly according to claim 7, wherein said housing further comprises two connection points for connecting said first capacitor and said inductive coil antenna via wires.

9. The antenna assembly according to claim 1, wherein said casing further comprises a construction connected to one end of said inductive coil antenna or both ends of said inductive coil antenna for receiving signals on the second frequency band, wherein said construction is preferably a patch, a wire or a stripline.

10. The antenna assembly according to claim 1, wherein:

said antenna casing is made of plastic, or said housing is made of metal, or said antenna casing is made of plastic and said housing is made of metal.

11. The assembly according to claim 1, wherein said housing encompasses a wristwatch-like device.

12. The assembly according to claim 1, wherein said first radio is a low-frequency band inductive receiver operating below 1 MHz.

13. The assembly according to claim 1, wherein said second radio is a Bluetooth radio operating on frequencies from 2.4 to 2.485 GHz.

14. The assembly according to claim 1, wherein said housing has the shape of a ring, an ellipse, a rectangle, a square, or any other polygon.

15. The assembly according to claim 1, wherein said casing further comprises an antenna extension for improving antenna efficiency at high frequencies.

16. An electronic wristwatch-like device, the device being suitable for underwater communications, comprising:

a casing, comprising an inductive coil antenna, wherein the inductive coil antenna is attachable to a housing; and said housing, comprising a first radio operating on a first frequency band for communication underwater and a second radio operating on a second frequency band for communication over air interface, wherein the second frequency band is higher than the first frequency band, and the first and the second radio operate using the inductive coil antenna when said casing is attached to said housing.

17. The device according to claim 16, wherein said first radio operates on the first frequency band and said second radio operates on the second frequency band simultaneously using the inductive coil antenna.

18. The device according to claim 16, wherein said housing further comprises an opening for attaching said casing to said housing.

19. The device according to claim 18, wherein said housing further comprises a multiplexer between said first radio and said opening, and said multiplexer is arranged to block signals on frequencies higher than a threshold.

20. The device according to claim 19, wherein said multiplexer is arranged to block signals on the second frequency band.

* * * * *